United States Patent [19]

Perucchi

[11] Patent Number: 4,991,154

[45] Date of Patent: Feb. 5, 1991

[54] TIMEPIECE

[75] Inventor: Norberto Perucchi, St. Blaise, Switzerland

[73] Assignee: Gianni Bulgari S.p.A., Rome, Italy

[21] Appl. No.: 304,450

[22] Filed: Feb. 1, 1989

[30] Foreign Application Priority Data

Feb. 1, 1988 [IT] Italy ..... 67062 A/88

[51] Int. Cl.[5] ..... G04B 19/00

[52] U.S. Cl. ..... 368/76; 368/77; 368/223

[58] Field of Search ..... 368/76, 77, 78, 80, 368/220–222, 223, 228, 233, 235

[56] References Cited

U.S. PATENT DOCUMENTS

| | | | |
|---|---|---|---|
| 555,387 | 2/1896 | Long | 268/221 |
| 1,959,831 | 5/1934 | Krzeminski | 368/26 |
| 2,051,611 | 8/1936 | Liner | 368/77 |
| 2,266,183 | 12/1941 | Fergusson | 368/77 |
| 3,675,411 | 7/1972 | Sakuma | 368/27 |
| 3,879,929 | 4/1975 | Charbonney | 368/28 |
| 4,006,588 | 2/1977 | McMahon | 368/233 |
| 4,059,232 | 4/1987 | Coster et al. | 368/223 |

*Primary Examiner*—Vit W. Miska

*Attorney, Agent, or Firm*—Sughrue, Mion, Zinn, Macpeak & Seas

[57] ABSTRACT

A timepiece includes an analogue-type display for displaying the minute at a given moment, constituted by a hand rotated at the rate of one revolution per hour by the mechanism of the timepiece, and a digital-type display for displaying the hour at a given moment, comprising a rotating member for displaying the figure indicative of the hour at a given moment and a drive mechanism for driving the display member which is controlled by the timepiece mechanism and is adapted to rotate the rotating member in jerks at intervals of one hour.

7 Claims, 4 Drawing Sheets

TIMEPIECE

BACKGROUND OF THE INVENTION

The present invention relates to timepieces and particularly to timepieces of the type comprising a case, a timepiece mechanism situated within the case, and means driven by the timepiece mechanism for displaying the hour and the minute at a given moment.

SUMMARY OF THE INVENTION

The object of the invention is to produce a timepiece in which the hour is displayed in such a way that it is easy and quick to read, whilst achieving an original aesthetic result compared with known timepieces.

In order to achieve this object, the timepiece according to the invention is characterised in that the means for displaying the minute at a given moment are of the analogue type, the means being constituted by a hand rotated at the rate of one revolution per hour by the timepiece mechanism, while the means for displaying the hour at a given moment are of the digital type, the means comprising a rotating member for displaying the figure inducative of the hour at a given moment and means for driving the display member which are controlled by the timepiece mechanism and are adapted to rotate the member in jerks at intervals of one hour.

In a preferred embodiment, the means for rotating in jerks the means for displaying the hour at a given moment comprise a spring device for storing, during the passing of an hour, the energy necessary for the hourly jerk of the display member, and a movable anchor device, which is independent of the spring device, for preventing rotation of the display member during the passing of the hour but enabling it to jerk into the new display position and subsequently stop at every change of hour.

BRIEF DESCRIPTION OF THE DRAWINGS

The present invention will now be described with reference to the appended drawings, provided purely by way of non-limiting example, in which.

DETAILED DESCRIPTION OF THE INVENTION

Figure 1:
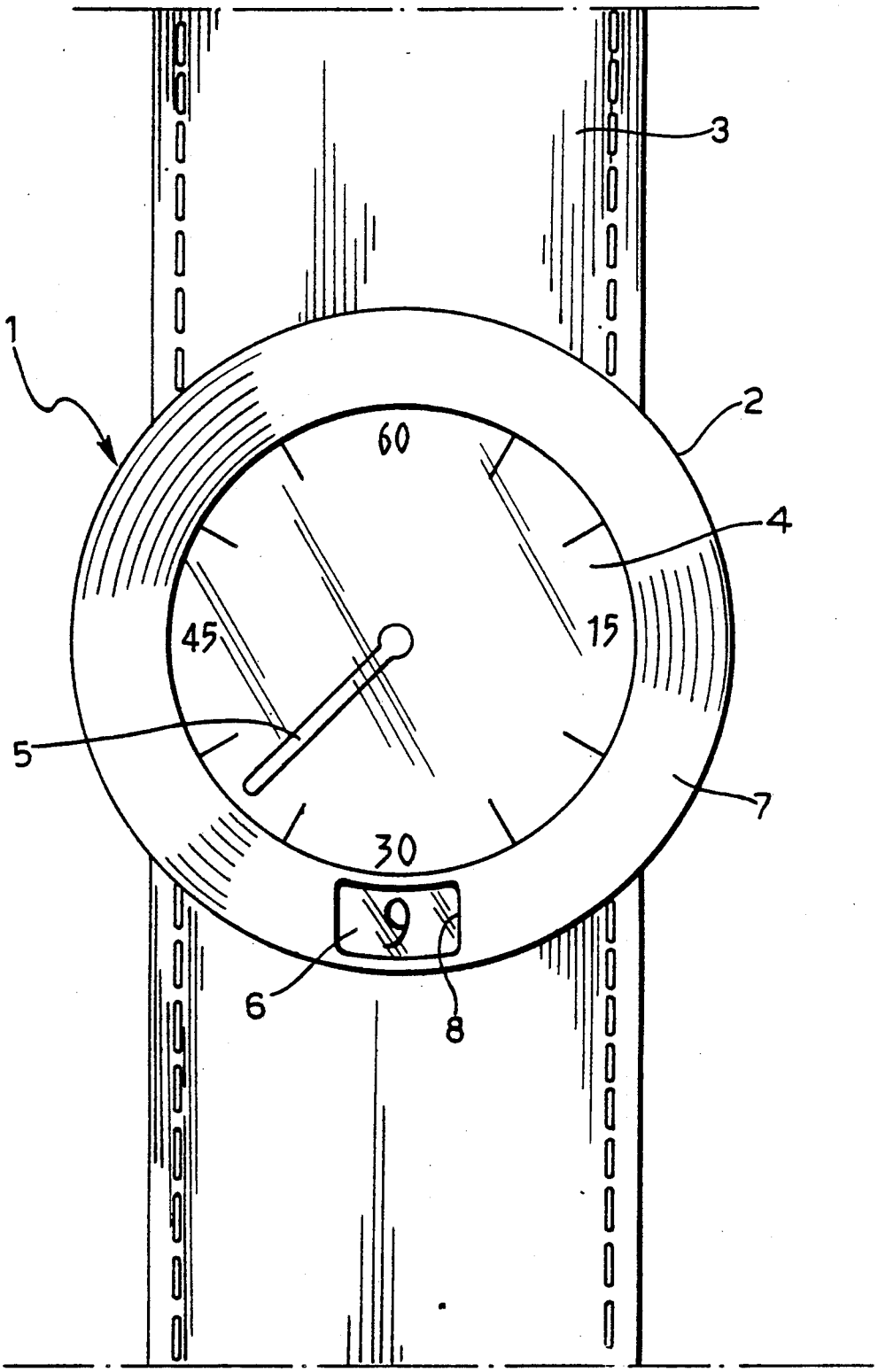
FIG. 1 is a schematic front view of a wrist-watch according to the present invention.

The embodiment illustrated in FIG. 1 of the appended drawings relates to a wrist-watch. The invention, however, is of course equally applicable to other types of timepiece. Similarly, the various details relating to the face and body of the timepiece may vary widely from those illustrated purely by way of example in FIG. 1. With reference to this drawing, the watch according to the invention, generally indicated 1, includes a case 2 which, in the wrist-watch illustrated, is connected to a strap 3, and a face 4.

In the watch according to the invention, the minute at a given movement is displayed analogically, according to conventional technology, by means of a hand 5 which is rotated at the rate of one revolution per hour by a watch mechanism situated within the case 2. The mechanism is not illustrated since it may be of any known type and does not fall within the scope of the present invention. Furthermore, the elimination of this mechanism from the drawings makes the latter more readily understood.

The hour at a given moment, however, is displayed digitally by means of a member for displaying the figure indicative of the hour at a given moment, which rotates in jerks at intervals of one hour. In the embodiment illustrated, the display member is constituted by a disc 6 which rotates in jerks beneath the face 4 and carries on its main surface the figures indicative of the hour at a given moment. Still with reference to the embodiment illustrated, the front surface of the case 2 has an annular peripheral zone 7 surrounding the face 4 and having an aperture 8 through which the figure indicative of the hour at a given moment can be seen. Since, as already indicated above and described in more detail below, the display disc 6 does not rotate continuously, but in jerks separated by intervals of one hour, the aperture 8 may be of a size which is just sufficient to enable the figure indicative of the hour to be read. In fact, the figure does not become only partially visible as the hour passes.

Naturally, the hour display member could also be of a different type from that shown by way of example in FIG. 1. For example, the figures indicative of the hour at a given moment could be shown on a fixed disc and the display member could be constituted by a disc rotating above the fixed disc and having an aperture or slot of some shape which enables the underlying figures shown on the fixed disc to be read.

With reference to FIGS. 2 to 5, the watch mechanism rotates a tubular shaft 9 for displaying the hour at the rate of one revolution per hour. According to conventional technology, the watch mechanism also drives a shaft for displaying the minute at a given moment, which passes through the tubular shaft 9 and is connected to the hand 5. This shaft is also not shown in the drawings, so as to make the latter more easily and quickly understood and again in view of the fact that the above arrangement corresponds to conventional technology.

The tubular shaft 9 carries a gear 10 (formed integrally with the shaft 9 in the embodiment illustrated) which meshes with a gear 11 of larger diameter supported rotatably by means of a pin 12 supported in turn by two walls 13, 14 which are fixed to the case of the watch. The transmission ratio of the pair of gears 10, 11 is 1:4, so that the gear 11 completes a quarter of a revolution per hour. The disc 6 for displaying the hour at a given moment is constituted by a ring which is supported rotatably in the case, for example, by means of a plurality of peripheral support pillars (not illustrated), and which has a toothed inner edge 16. The toothed edge 16 meshes with a further gear 17 which is rotatably supported on the pin 12 independently of the gear 11.

A coil spring 18 is operatively interposed between the gears 11 and 17. The coil spring 18 has its outer end 19 fixed to the gear 11 by means of a pin 20 and its inner end 21 mounted around the pin 12. Near its inner end, the coil 18 is also fixed to the gear 17 by means of a pin 22. The pin 22 also engages an arcuate slot 23 formed in the gear 11 and extending through an angle greater than 90°, as well as a similar slot 24 (FIG. 3) formed in a fixed support wall 25.

The hour shaft 9 also carries a disc 26 bearing a toothed sector 27 which obviously also rotates at the rate of one revolution per hour. At each revolution, the sector 27 meshes with a pinion 28 which is rotatably supported by the fixed walls 13, 29 (FIG. 4) by means of a pin 30. The pin 30 is connected for rotation with a pinion 28 and carries an eccentric 31. The number of teeth of the toothed sector 27 of the pinion 28 is such that, for each passage of the sector 27, the pinion 28 completes half a revolution.

The pinion 28 also cooperates with a resilient plate 15 (FIG. 2) having one end which is bent into a V-shape in contact with the pinion and its opposite end (not visible in FIG. 2) fixed to the case. When the sector 27 meshes with the pinion 28, the latter rotates to cause the reciprocating movement of the plate 15 between the undeformed position illustrated and a position in which it is bent. When the sector 27 is not meshed with the pinion 28, the latter is held in a fixed position by the plate 15.

Figure 4:
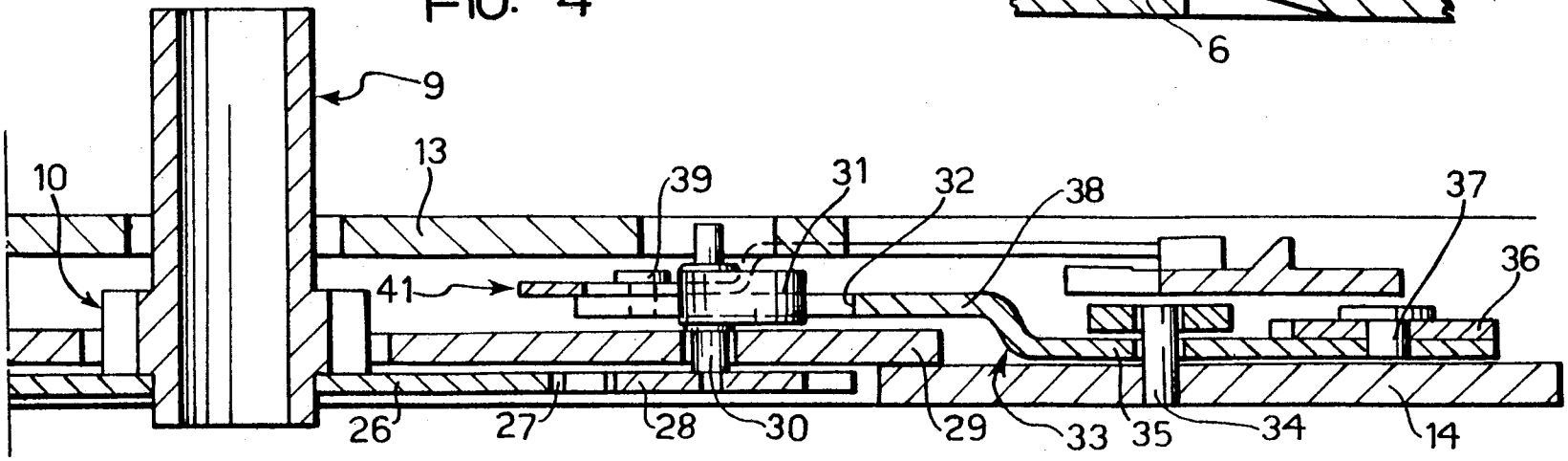

The eccentric 31 of the pin 30 is engaged in a slot 32 in an anchor 33 pivotably mounted on the fixed wall 14 by means of an articulation pin 34 (FIG. 4). In the embodiment illustrated, the anchor 33 comprises a plate having a first portion 35 articulated to the wall 14, as shown, by means of the pin 34 and provided at one end with a plate 36 fixed by means of a pin 37 and acting as a counterweight. At the opposite end, the main plate forming the anchor 33 has a second portion 38 situated in a plane which is offset from the plane of the portion 35 and having a slot which opens at the end of the plate so as to make the portion 38 substantially fork-shaped in plan. The two arms 40 of a substantially U-shaped resilient plate 41 are fixed by means of pins 39 to the two arms of the fork. The inside edge of the central part of the plate 41 defines—together with the slot in the portion 38 of the anchor 33—the slot 32 which is engaged by the eccentric 31. The arms 40 of the resilient plate 41 can deform resiliently in a direction perpendicular to the plane of FIG. 2 of the appended drawings.

The toothed edge 16 of the hour-display disc 6 has raised tabs 42 formed by blanking and bending (see FIGS. 2, 5) in correspondence with six equiangularly-spaced zones.

Figure 2:
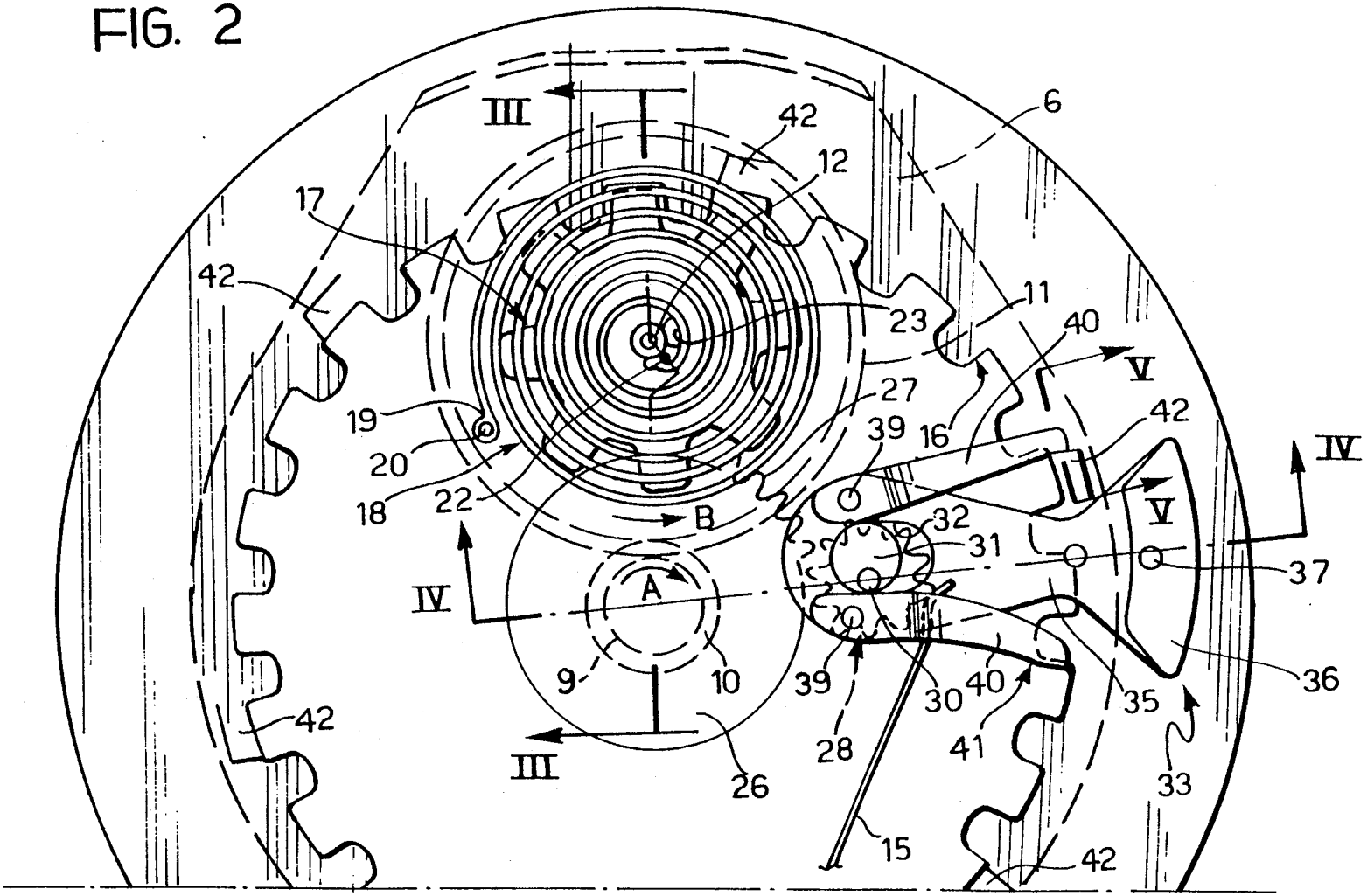
FIG. 2 is a schematic front view of part of the internal mechanism of the watch.
Figure 3:
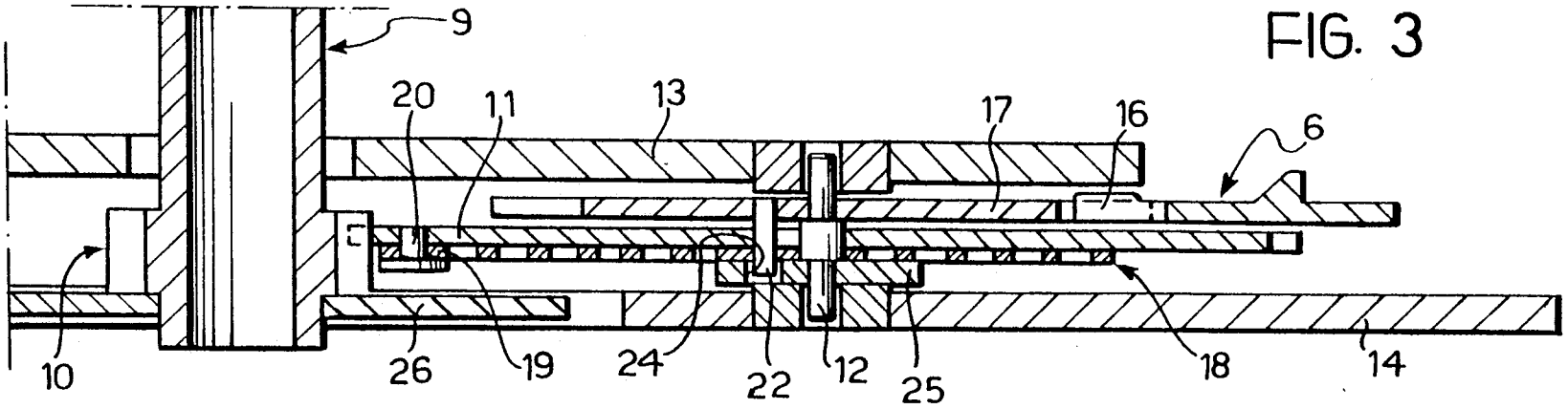
FIGS. 3, 4 and 5 are sections taken on the lines III—III, IV—IV and V—V of FIG. 2 respectively, on an enlarged scale.
Figure 5:
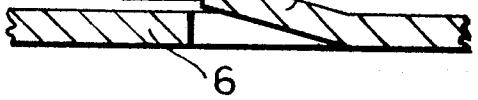
Figure 6:
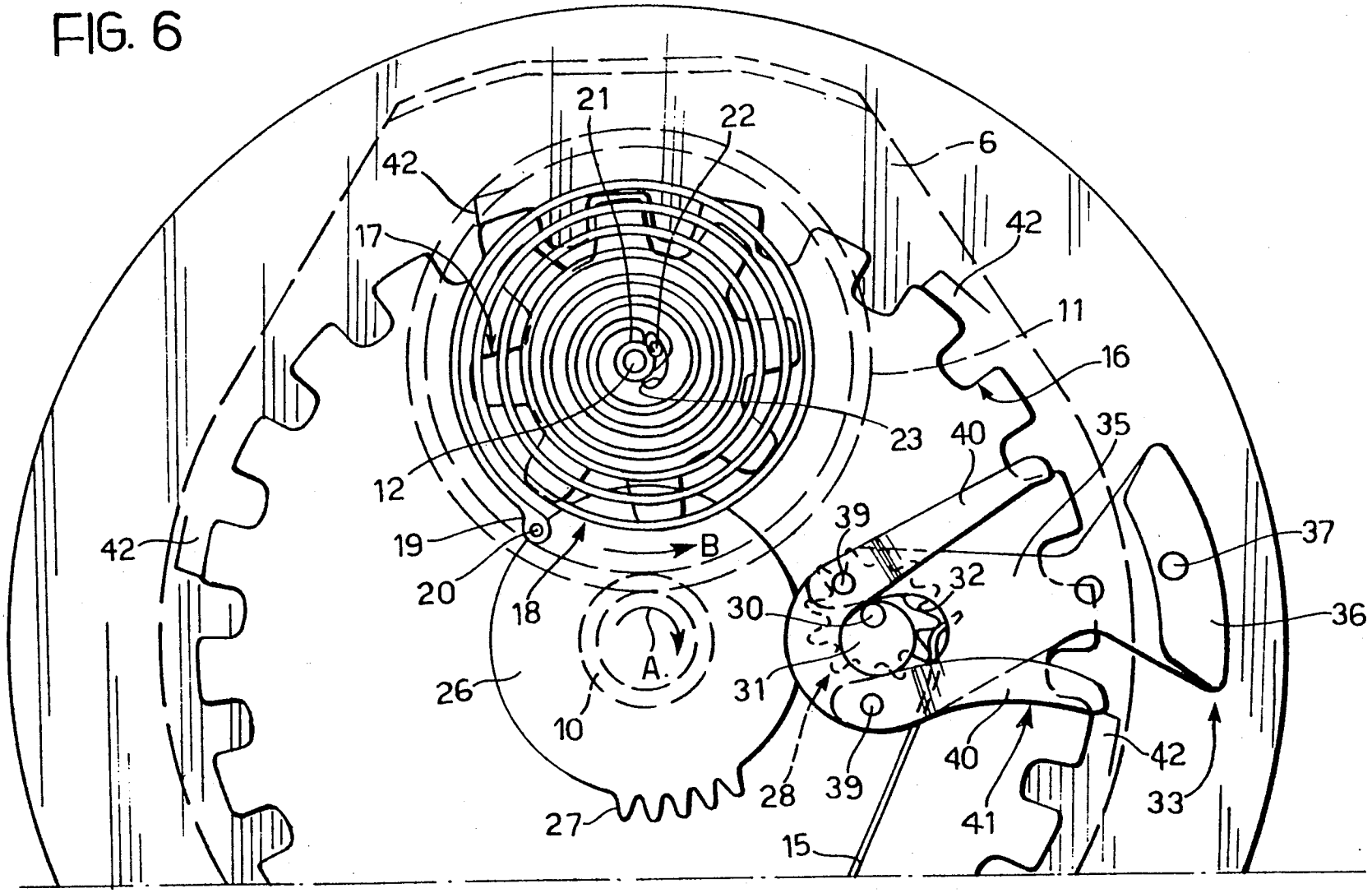
FIG. 6 is a view corresponding to that of FIG. 2 which shows the mechanism in a different operatiive condition.

As a result of the rotation of the eccentric 31 in the slot 32, the pivoting anchor 33 is moved reciprocally between a first end position illustrated in FIG. 2 and a second end position illustrated in FIG. 6. In each of these two end positions, a respective arm 40 of the plate 41 is engaged with one of the tabs 42.

The operation of the watch described above is as follows:

as already indicated above, the minute at a given moment is displayed analogically, according to conventional technology, by means of the hand 5 which is driven by the minute shaft from the watch mechanism. The hour at a given moment, however, is displayed by the disc 6 which brings the various figures indicative of the hour successively into correspondence with the aperture 8 (FIG. 1). With reference to FIG. 2, during the passing of the hour, the gear 10 rotates clockwise, that is, in the sense of the arrow A in FIG. 2, at the rate of one revolution per hour. This rotation causes a corresponding anticlockwise rotation, that is, in the sense of the arrow B in FIG. 2, of the gear 11 at the rate of one quarter of a revolution per hour. The gear 11 entrains the outer end 19 of the coil spring 18 in rotation, whilst the inner end 21 thereof cannot rotate since the pin 22 fixes that end to the gear 17 which cannot rotate anticlockwise since it is meshed with the toothed edge 16 of the display disc 6. This ring gear cannot rotate anticlockwise since one of the tabs 42 is engaged with one of the two arms 40 of the resilient plate 41 (in particular, the upper arm illustrated in FIG. 2). With the passage of the time following a change of hour, therefore, the display disc 6 is held in a fixed position and the user still reads the same figure in the aperture 8 of the watch. During the passing of the hour, the coil spring 18 continues to be loaded, slowly storing the energy which will be required to cause the jerk of the display disc 6 at the time when the hour changes. The position illustrated in FIG. 2 corresponds exactly to the condition which occurs at a distance of 6'40" from the next change of hour. When the hour elapses, the toothed sector 27 rotates the pinion 28 which, by means of the eccentric 31 and the slot 32, moves the pivoting anchor 33 from the position illustrated in FIG. 2 to the position illustrated in FIG. 6. As soon as the movable anchor has moved from the position illustrated in FIG. 2, the arm 40 of the resilient plate which is in the upper position in FIG. 2 is disengaged from the respective tab 42 to enable the anticlockwise rotation of the toothed edge 16. This rotation takes place practically instantaneously by virtue of the energy released by the coil spring 18 which had previously been loaded. The latter rotates the gear 17 and consequently the toothed edge 16 until the next tab 42 of the ring comes into engagement with the other arm 40 of the resilient plate 41, as illustrated in FIG. 6. The instantaneous rotation of the ring 6 thus takes place through an angle of exactly 30°, so as to bring a new figure indicative of the hour at the given moment into correspondence with the aperture 8. The subsequent operation is similar to that described above and is repeated cyclically.

Any device of known type adapted to rotate the gear 10 anticlockwise is used for the adjustment of the hour displayed on the watch. This device is not illustrated in the appended drawings since, as already indicated, it may be of any known type and does not fall within the scope of the invention. The anticlockwise rotation of the gear 10 causes a clockwise rotation of the gear 11. The gear 11 entrains the gear 17 in rotation by means of the coil spring 18, the pin 22 and the slot 23. The gear 17 in turn rotates the ring gear clockwise. The rotation is not prevented by the engagement of the tabs 42 on the arms 40 of the resilient plate 41, since the back of each tab 42 acts as a cam surface which causes the arms 40 of the resilient plate 41 to be raised and thus enables the tabs 42 to pass beneath the arms. The hour display disc 6 is therefore able to rotate continuously clockwise as a result of the drive imparted by means of the hour adjustment device.

What is claimed is:

1. A timepiece comprising a case, a timepiece mechanism situated within the case, and display means driven by the timepiece mechanism for displaying the hour and the minute at a given moment, said display means comprising minute means of an analog type for displaying the minute at a given moment, the minute means being constituted by a hand rotated at the rate of one revolution per hour by the timepiece mechanism, while hour means for displaying the hour at a given moment are a digital type, the hour means comprising a rotating display member for displaying a figure indicative of the hour at a given moment and drive means for driving the display member which are adapted to rotate the display member in jerks at intervals of one hour, said drive means for rotating the display member for displaying the hour at a given moment comprises a spring device for storing, during the passing of the hour, the energy necessary for the hourly jerk of the display member, and a movable anchor device which is independent of the spring device, for preventing the rotation of the display member during the passing of the hour but enabling it to jerk into the new display position and subsequently stop at every change of hour, said spring device including:

a first gear rotated at the rate of one revolution per hour by the timepiece mechanism, a second gear meshed with the first gear and having a larger diameter than the latter, a ring gear connected to the member for displaying the hour at a given moment, a third gear meshing with the ring gear and coaxial with the second gear, a coil spring having one end connected to the second gear and its opposite end connected to the third gear, an anchor mounted for pivoting between two end positions and provided with two stop members adapted to engage, in the two end positions respectively, engagement surfaces provided in equiangularly-spaced positions on the ring gear in order to stop the display member in the positions for displaying the hours at given moments, and an eccentric transmission driven by the timepiece mechanism for causing the pivoting of the anchor.

2. A timepiece according to claim 1, wherein the outer end of the coil spring (18) is fixed to the second gear (11), whilst its inner end (21) is fixed to the third gear (17) by means of a pin (22) which also engages an arcuate slot (23) in the second gear (11).

3. A timepiece according to claim 1, wherein the stop members (40) of the pivoting anchor (33) are constituted by the two arms of a resilient U-shaped plate (41) fixed to the pivoting anchor (33).

4. A timepiece according to claim 3, wherein the eccentric transmission comprises a pinion (28) freely rotatably mounted in the case of the timepiece, a toothed sector (27) entrained for rotation with the first gear (10) and adapted to rotate the pinion (28) by half a revolution for each revolution of the first gear (10), and an eccentric (31) carried by the central pin (30) of the pinion (28) and engaged in a slot (32) in the pivoting anchor (33).

5. A timepiece according to claim 3, wherein the engagement surfaces of the ring gear (16) are constituted by projecting tabs (42) formed in the ring gear (16) by blanking and bending, so that the tabs (42) prevent rotation of the ring gear (16) in one sense as a result of their engagement with the stop members of the pivoting anchor, whilst enabling the ring gear (16) to rotate in the opposite sense.

6. A timepiece according to claim 1, wherein the display member is constituted by a disc carrying the figures indicative of the hours, the disc being situated beneath a wall (7) which has an aperture (8) for the reading of the figure indicative of the hour at a given moment.

7. A timepiece according to claim 1, wherein the timepiece includes a fixed disc carrying the figures indicative of the hours, and in that the member for displaying the hour at a given moment comprises a rotating disc having an aperture which enables the figure indicative of the hour at a given moment to be read.

* * * * *